US010872740B2

(12) United States Patent
Zhang et al.

(10) Patent No.: US 10,872,740 B2
(45) Date of Patent: Dec. 22, 2020

(54) ELECTRICAL DC SWITCHING SYSTEM

(71) Applicant: ABB Schweiz AG, Baden (CH)

(72) Inventors: Zichi Zhang, Västerås (SE); Stefan Valdemarsson, Lidköping (SE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 16/615,985

(22) PCT Filed: May 17, 2018

(86) PCT No.: PCT/EP2018/062859
§ 371 (c)(1),
(2) Date: Nov. 22, 2019

(87) PCT Pub. No.: WO2018/219659
PCT Pub. Date: Dec. 6, 2018

(65) Prior Publication Data

US 2020/0144008 A1 May 7, 2020

(30) Foreign Application Priority Data

May 31, 2017 (EP) ..... 17173790

(51) Int. Cl.
*H01H 33/59* (2006.01)
*H01H 33/16* (2006.01)

(52) U.S. Cl.
CPC ..... *H01H 33/596* (2013.01); *H01H 33/167* (2013.01)

(58) Field of Classification Search
CPC ..... H01H 33/596; H01H 33/167; H01H 33/14
See application file for complete search history.

(56) References Cited

U.S. PATENT DOCUMENTS 10,418,210 B2 * 9/2019 Kim ..... H01H 33/596
2013/0020881 A1 1/2013 Panousis et al.
(Continued)

FOREIGN PATENT DOCUMENTS

JP S62113326 A 5/1987
WO 2015091844 A1 6/2015
(Continued)

OTHER PUBLICATIONS

Chinese Office Action with Translation Application No. 2018800337204 dated May 12, 2020 9 pages.
(Continued)

*Primary Examiner* — Daniel J Cavallari
(74) *Attorney, Agent, or Firm* — Whitmyer IP Group LLC

(57) ABSTRACT

An electrical DC switching system for extinguishing an electric arc, wherein the electrical DC switching system includes: a main contact arrangement having a first contact and a second contact, the main contact arrangement being operable between a closed position and an open position, a plurality of serial contacts connected in series with each other and connected in parallel with the main contact arrangement, each serial contact being operable between a closed position and an open position, wherein in a current breaking operation the main contact arrangement is configured to be set in the open position before the plurality of serial contacts are configured to be set in their open positions, and a current injection circuit including a resonance circuit configured to be connected across the serial contacts, and a first switch configured to be switched between an open state and a closed state and configured to be connected to the resonance circuit and to the serial contacts, wherein the first switch is configured to be set in the closed state when the serial contacts are in their open positions to enable an injection current to flow through the resonance circuit and
(Continued)

into the serial contacts in a first flow direction which is opposite to a flow direction of an arc current flowing through the serial contacts.

14 Claims, 3 Drawing Sheets

(56) References Cited

U.S. PATENT DOCUMENTS

2016/0315467 A1 10/2016 Eckel et al.
2016/0329179 A1* 11/2016 Kim ..... H01H 9/542

FOREIGN PATENT DOCUMENTS

WO 2016131949 A1 8/2016
WO WO-2016167490 A1 * 10/2016 ..... H01H 9/54

OTHER PUBLICATIONS

Extended European Search Report Application No. 17173790.1 Completed: Dec. 8, 2017; dated: Jan. 2, 2018 8 Pages.
International Search Report and Written Opinion of the International Searching Authority Application No. PCT/EP2018/062859 Completed: Aug. 3, 2018; dated Aug. 22, 2018 14 Pages.

* cited by examiner

ELECTRICAL DC SWITCHING SYSTEM

TECHNICAL FIELD

The present disclosure generally relates to an electrical DC switching system for extinguishing an electric arc. In particular it relates to an electrical DC switching system of a type that relies on artificial zero-crossings for arc extinguishing purposes.

BACKGROUND

Switching systems are used for interrupting a current or protecting an electric circuit in the event of an electrical failure for example due to a short circuit. Switching systems may comprise contacts which during normal operation are in mechanical connection. When the contacts are separated from each other a current breaking operation is effected. In addition to separating the contacts, a current breaking operation involves extinguishing an arc between the contacts, and to force the current to zero.

Alternating current (AC) switching systems utilize the naturally occurring zero-crossings of the alternating current flowing through the switching system for extinguishing the arc.

Direct current (DC) switching systems cannot utilize natural zero-crossings since there are none. It is known to create artificial zero-crossings for DC switching systems in order to be able to perform a current breaking operation. One way to obtain an artificial zero-crossing is by utilizing a resonance circuit connected across the contacts. The resonance circuit comprises a capacitor which is continually charged by an energy source. The capacitor is charged to obtain a polarity which enables a capacitor discharge current to flow through the contacts in the opposite direction relative to the arc current flowing through the arc. The arrangement furthermore comprises a switch which normally is in its open state. When a current breaking operation is effected and the contacts are separated, the switch is closed, wherein the capacitor discharges its electric charge and the resonance circuit provides a current pulse into the contacts. The current pulse flows in the opposite direction relative to the arc current. By selecting suitable values of the capacitor and inductance in the resonance circuit, an artificial zero-crossing is obtained. At this time the arc generated at the contacts, which enables the arc current to continue to flow after opening of the separation of the contacts, may be extinguished by deionization of the hot plasma and/or gas in the gap between the contacts. In this manner it is possible to break the arc current.

The above-described artificial zero-crossing creation requires that the capacitor is charged at all times. Furthermore a power supply is needed to constantly charge the capacitor. Moreover, the artificial zero-crossing provides for only a single chance to successfully extinguish the arc and thus to break the arc current.

WO 2016/131949 A1 discloses a switching system for breaking a current which allows for several opportunities to successfully extinguish the arc and thus to break the arc current, by providing several subsequent artificial zero-crossings utilizing a resonance circuit and switches to use the arc current repeatedly inject a reverse current into the contact arrangement.

JP S62 113326 A discloses a DC circuit breaker comprising a plurality of series connected contacts and a resonance circuit connected in parallel with the series connected contacts and which is able to inject a reverse current into the series contacts.

SUMMARY

In conventional DC switching systems for breaking a current, the arc travels across the splitter plates with a voltage between each splitter plate that may be in the order of about 25 volts. These voltages sum up to a reverse voltage of the same magnitude as that provided by the DC voltage source which feeds the contacts. Hence, as an example, in the order of a hundred of such splitter plates are necessary to obtain a reverse voltage equal to that of a 2000V DC voltage source. The current can in this manner relatively slowly be decreased from the arc current value to zero.

In DC switching systems of the type that inject a current in the reverse direction compared to the arc current, the current flowing through the contact arrangement will relatively quickly become zero. As a result, a very quick build-up of a reverse voltage equaling the DC voltage source level is obtained across the splitter plates once an artificial zero-crossing has been created.

Hence, according to the conventional approach a reverse voltage is built up across the splitter plates to thereby obtain a current reduction, relatively slowly reducing the current to zero after the reverse voltage has built up to the level of the DC voltage source. According to the conventional approach, a great plurality of splitter plates is needed to build up the required voltage level. As previously noted the number of splitter plates required may for example be in the order of a hundred. The current injection approach on the other hand sets the current to zero by injecting a current in the reverse direction, and when the current is zero the reverse transient voltage across the splitter plates builds up to the magnitude of the voltage of the DC voltage source. The arc extinguishing principle of the current injection approach is hence very different to that of the conventional approach. In particular, according to the current injection method the splitter plates are only used as a means of deionizing the post arc gas and not, as in the conventional case, as a reverse voltage source which sums up to a reverse voltage of the same magnitude as that provided by the DC voltage source which feeds the contacts. This means that there is no need to build up the reverse voltage from the sum of arc voltages between for example hundred splitter plates in order to create a zero-crossing. When combined with the current injection approach, the number of splitter plates needed is only governed by the withstand ability of the post arc gaps and would in this same example only be about ten.

In other words, since by means of current injection methods the reverse voltage is essentially attained as a result of the current reaching zero, the number of splitter plates need not be chosen so large as for the conventional case and hence the potential difference between each adjacent splitter plate is permitted to reach much higher transient voltage levels than in the conventional case. The potential difference between adjacent splitter plates could in particular be in the order of ten higher than in the conventional case. This means that the number of splitter plates could be reduced with about 90% in the current injection case.

When using splitter plates in combination with the current injection approach the arc will travel via the arc runners to the splitter plates. This means that the current injection to obtain the zero-crossing must be delayed until the arc has reached the splitter plates. Otherwise, there is a risk of arc re-ignition between the arc runners, because it is difficult to cool the gas between the arc runners effectively.

WO2015091844 is based on the conventional reverse voltage build-up approach but uses a different method than splitter plates for arc extinction. WO2015091844 discloses a DC switchgear comprising first switch contacts and a second current pathway arranged in parallel with the first switch contacts. The second current pathway has a plurality of second switch contacts arranged in series and a sequential circuit is designed to disconnect the second switch contacts from each other. In a first step of current interruption the first switch contacts are disconnected and in a second step the second switch contacts are disconnected from each other. The commutation of current to the second current path ensures that the arcs appear immediately across the second switch contacts at opening.

A drawback with WO2015091844 is that it cannot be used for higher voltages. It is not possible to commutate current into too many series-contacts, which would be necessary in WO2015091844 to obtain an adequate reverse voltage is built up across the second switch contacts to obtain a current reduction. The contact resistance times the current must be lower than the voltage across the first switch contacts, and contact resistance increases with the number of second switch contacts.

Having realized the aforementioned considerations regarding the different operating principles between the conventional approach and the current injection approach, the present inventors have found means to solve the above-mentioned problems while ensuring that the electrical DC switching system obtains a small footprint and low material cost. The inventors have surprisingly found that, by means of a combination of the current injection approach and the use of a plurality of series-connected serial contacts connected in parallel with the main contact arrangement, the number of series-connected serial contacts may be reduced with about 90% when combined with the current injection approach compared to the case disclosed in WO2015091844. Since the number of contacts may be reduced, the voltage rating of the present electrical DC switching system may be increased substantially while maintaining the function to commute current from the main contact arrangement into the series-connected serial contacts.

In view of the above, an object of the present disclosure is to provide an electrical DC switching system which solves, or at least mitigate, the problems of the prior art.

There is hence provided an electrical DC switching system for extinguishing an electric arc, wherein the electrical DC switching system comprises: a main contact arrangement having a first contact and a second contact, the main contact arrangement being operable between a closed position and an open position, a plurality of serial contacts connected in series with each other and connected in parallel with the main contact arrangement, each serial contact being operable between a closed position and an open position, wherein in a current breaking operation the main contact arrangement is configured to be set in the open position before the plurality of serial contacts are configured to be set in their open positions, and a current injection circuit including a resonance circuit configured to be connected across the serial contacts, and a first switch configured to be switched between an open state and a closed state and configured to be connected to the resonance circuit and to the serial contacts, wherein the first switch is configured to be set in the closed state when the serial contacts are in their open positions to enable an injection current to flow through the resonance circuit and into the serial contacts in a first flow direction which is opposite to a flow direction of an arc current flowing through the serial contacts, wherein each serial contact consists of a non-magnetic material.

An effect which may be obtainable by the above-identified differences in view of JP S62 113326 A is that the risk of arc re-ignition may be reduced because by having the main contact, one is free to select material with very good recovery withstand voltage for the serial contacts for arc extinction, in particular non-magnetic material. Such material is however not suitable for load carrying purposes.

While optimizing the arc extinguishing properties using serial contacts consisting of non-magnetic material, the main contact arrangement may be selected to be made of a material optimal for normal operation to carry load currents. In JP S62 113326 A the serial contacts carry the load current and also act to extinguish the arc, and therefore cannot be optimized for the different purposes.

One advantage with being able to use fewer serial contacts is that the total energy created inside the DC switching system is a small fraction (<one tenth) compared to the conventional method. Hence the problem of taking care of the hot gas and the arcing energy is considerably reduced.

According to one embodiment the main contact arrangement comprises a silver or a silver alloy. Thus, the first contact and the second contact may comprise silver or a silver alloy. Silver and silver alloy are examples of materials suitable for load carrying purposes.

According to one embodiment the main contact arrangement consists of silver or a silver alloy. Thus, the first contact and the second contact may consist of silver or a silver alloy.

The withstand voltage between adjacent serial contacts immediately after current zero is considerably higher than the arcing voltage, typically ten times, if non-magnetic material is used in the serial contacts. Hence the number of serial contacts can be reduced to only about one tenth because the sum of the arcing voltages is of no interest as for the conventional approach.

There is no need to use magnetic material in the serial contacts, because the arc does not have to be attracted like it has to be when using splitter plates.

According to one embodiment the non-magnetic material is brass or zinc.

According to one embodiment the resonance circuit comprises a capacitor and an inductor.

According to one embodiment the current injection circuit comprises a DC power source configured to charge the capacitor when the first switch is in the open position.

One embodiment comprises a control system, wherein the current injection circuit comprises a second switch connected to the resonance circuit and to the serial contacts, wherein the second switch is configured to be switched between an open state and a closed state, wherein in the closed state the second switch is configured to enable current to flow through the resonance circuit in a second flow direction opposite to the first flow direction, and wherein the control system is configured to alternatingly first set the first switch, and then the second switch, first in the closed state and then in the open state upon a current breaking operation, until a current pulse, emanating from energy supplied by the arc current, flowing through the resonance circuit and into the serial contacts reaches an amplitude which is equal to or greater than a magnitude of the arc current.

According to one embodiment in each iteration of alternatingly first setting the first switch, and then the second switch, first in the closed state and then in the open state, the control system is configured to: set the first switch in the closed position, enabling a first current pulse to flow through the resonance circuit in the first flow direction, set first the first switch in the open state and then the second switch in the closed state when the first current pulse has become zero to enable a second current pulse to flow through the resonance circuit in the second flow direction, and to set the second switch in the open state when the second current pulse first has become zero.

According to one embodiment the second switch is connected across the resonance circuit.

According to one embodiment the resonance circuit comprises a capacitor and an inductor.

According to one embodiment the current injection circuit comprises a DC power source configured to charge the capacitor when the first switch is in the open position. The DC power source is in particular configured to charge the capacitor such that the injection current flowing through the resonance circuit and into the contact arrangement when the first switch is set in the closed state is in the reverse direction in relation to the contact arrangement arc current.

One embodiment comprises a control system, wherein the current injection circuit comprises a second switch connected to the resonance circuit and to the second contact of the contact arrangement, wherein the second switch is configured to be switched between an open state and a closed state, wherein in the closed state the second switch is configured to enable current to flow through the resonance circuit in a second flow direction opposite to the first flow direction, and a control system, wherein the control system is configured to alternatingly first set the first switch, and then the second switch, first in the closed state and then in the open state upon a current breaking operation, until a current pulse, emanating from energy supplied by the contact arrangement arc current, flowing through the resonance circuit and into the contact arrangement, and thereafter into the splitter plates reaches an amplitude which is equal to or greater than a magnitude of the contact arrangement arc current.

According to one embodiment in each iteration of alternatingly first setting the first switch, and then the second switch, first in the closed state and then in the open state, the control system is configured to: set the first switch in the closed position, enabling a first current pulse to flow through the resonance circuit in the first flow direction, set first the first switch in the open state and then the second switch in the closed state when the first current pulse has become zero to enable a second current pulse to flow through the resonance circuit in the second flow direction, and to set the second switch in the open state when the second current pulse first has become zero.

According to one embodiment the second switch is connected across the resonance circuit.

One embodiment comprises a varistor connected in parallel with the main contact arrangement. The varistor may for example be a metal oxide varistor (MOV). By means of the varistor, the transient recovery voltage across the main contact arrangement can be reduced, reducing the risk of arc re-ignition.

Generally, all terms used in the claims are to be interpreted according to their ordinary meaning in the technical field, unless explicitly defined otherwise herein. All references to "a/an/the element, apparatus, component, means, etc.," are to be interpreted openly as referring to at least one instance of the element, apparatus, component, means, etc., unless explicitly stated otherwise.

BRIEF DESCRIPTION OF THE DRAWINGS

The specific embodiments of the inventive concept will now be described, by way of example, with reference to the accompanying drawings, in which.

DETAILED DESCRIPTION

Figure 1:
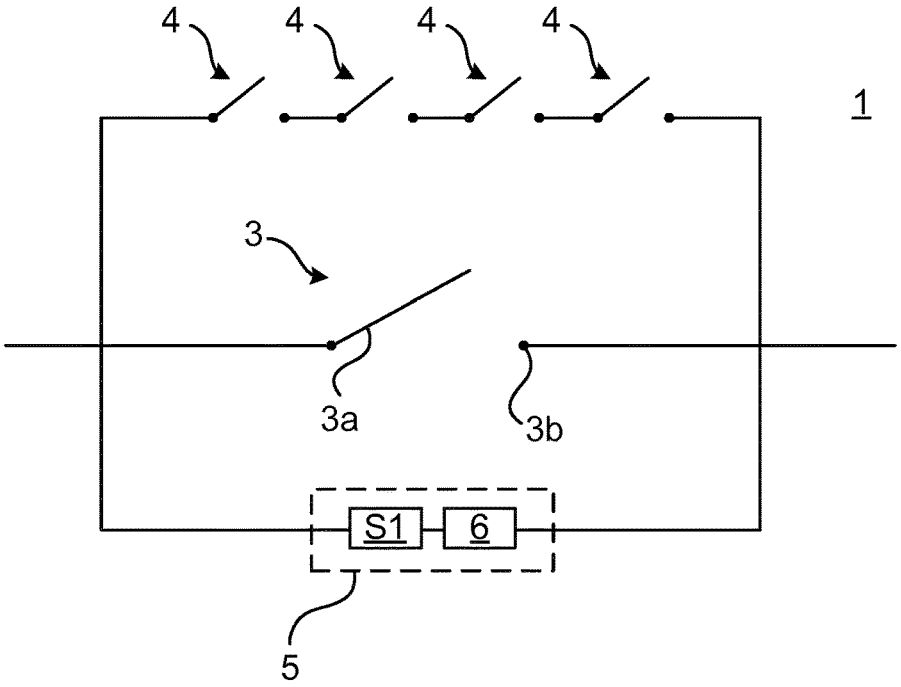
FIG. 1 shows an example of an electrical DC switching system for breaking a current.

The inventive concept will now be described more fully hereinafter with reference to the accompanying drawings, in which exemplifying embodiments are shown. The inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description.

A number of variations of an electrical DC switching system for breaking a current will be described herein. The electrical DC switching system comprises a main contact arrangement having a movable breaker contact and a fixed contact. The breaker contact can be actuated between a closed position in which it is in mechanical contact with the fixed contact and an open position in which the breaker contact is mechanically separated from the fixed contact. The movable breaker contact defines a first contact of the contact arrangement and the fixed contact defines a second contact of the contact arrangement. The main contact arrangement may for example comprise or consist of silver or a silver alloy. The movable breaker contact and the fixed contact may hence comprise or consist of silver or a silver alloy.

The electrical DC switching system comprises a plurality of serial contacts connected in series with each other and connected in parallel with the main contact arrangement. Each serial contact is configured to be operated between a closed position and an open position. Each serial contact may comprise a fixed contact and a breaker contact which is arranged movably with respect to the fixed contact. In the closed position of a serial contact the corresponding fixed contact and breaker contact are in mechanical contact. In the open position the breaker contact is mechanically separated from the fixed contact.

The serial contacts consist of a non-magnetic material. Examples of non-magnetic material are brass, zinc, copper, silver, gold, magnesium or various alloys of the aforementioned materials.

The serial contacts may be constructed in a plurality of different ways. It is in general advantageous to make the package formed by the serial contacts as small as possible to ensure a small footprint of the electrical DC switching system. The serial contacts may for example be arranged mechanically in parallel with each other, side by side and adjacent to each other with an electrically insulating partitioning wall arranged between each adjacent serial contact.

A compact serial contact package can be provided in this manner. A plurality of other serial contact configurations is also envisaged.

The main contact arrangement and the serial contacts are normally set in their closed positions. Thus, when the electrical system in which the electrical DC switching system is connected operates normally without any fault, the main contact arrangement and the serial contacts are set in their closed positions. In a current breaking operation, the main contact arrangement is first configured to be set in the open position. The current is thereby commutated to the serial contacts. The serial contacts are thereafter configured to be set in their open positions. The serial contacts are configured to be set in their respective open position simultaneously.

The electrical DC switching system comprises a current injection circuit including a resonance circuit, which is an LC-circuit comprising a capacitor and an inductor, and a first switch. The inductor may either be an inductor component or the inherent inductance of the conductors to which the capacitor is connected.

The resonance circuit is configured to be connected across the serial contacts. The first switch is configured to be switched between a closed state and an open state. The first switch is configured to be set in the closed state when the serial contacts are set in their open positions. When in the closed state, an injection current is able to flow through the resonance circuit and into the serial contacts in a direction opposite to a flow direction of an arc current flowing through the serial contacts. The current injection circuit is, via the resonance circuit, configured to inject an injection current with an amplitude which is equal to or greater than a magnitude of the arc current. In this manner arc extinction may be provided.

A plurality of examples of an electrical DC switching system will now be explained with reference to FIGS. 1-3.

FIG. 1 shows a general example of an electrical DC switching system 1 for breaking a current and to extinguish an electric arc. DC switching system 1 comprises a main contact arrangement 3 having a first contact 3*a* and a second contact 3*b*. The first contact 3*a* may be a movable breaker contact and the second contact 3*b* may be a fixed contact. The main contact arrangement 3 may be set in an open position by moving the breaker contact away from the fixed contact, and in a closed position in which the breaker contact is in mechanical contact with the fixed contact.

The electrical DC switching system 1 comprises a plurality of serial contacts 4 connected in series with each other. The serial contacts 4 are connected in parallel with the main contact arrangement 3. Although four serial contacts 4 are shown in the example, it is to be noted that there may be fewer than four serial contacts or more than four serial contacts provided. The number of serial contacts typically depends on the voltage rating of the electrical DC switching system 1.

In normal operation, when no arc is to be extinguished, the main contact arrangement 3 and the serial contacts 4 are in the closed position. DC current will in this case flow mainly through the main contact arrangement 3 due to for example lower contact resistance. When the main contact arrangement 3 is set in the open position the DC current will be commutated to the serial contacts 4.

The electrical DC switching system 1 also includes a current injection circuit 5 including a resonance circuit 6 connected across the serial contacts 4, and a first switch S1. The resonance circuit 6 includes a capacitor and an inductor. Alternatively the inductor comprises the inductance of the circuit path of the injection current, forming an LC-circuit.

Figure 2:
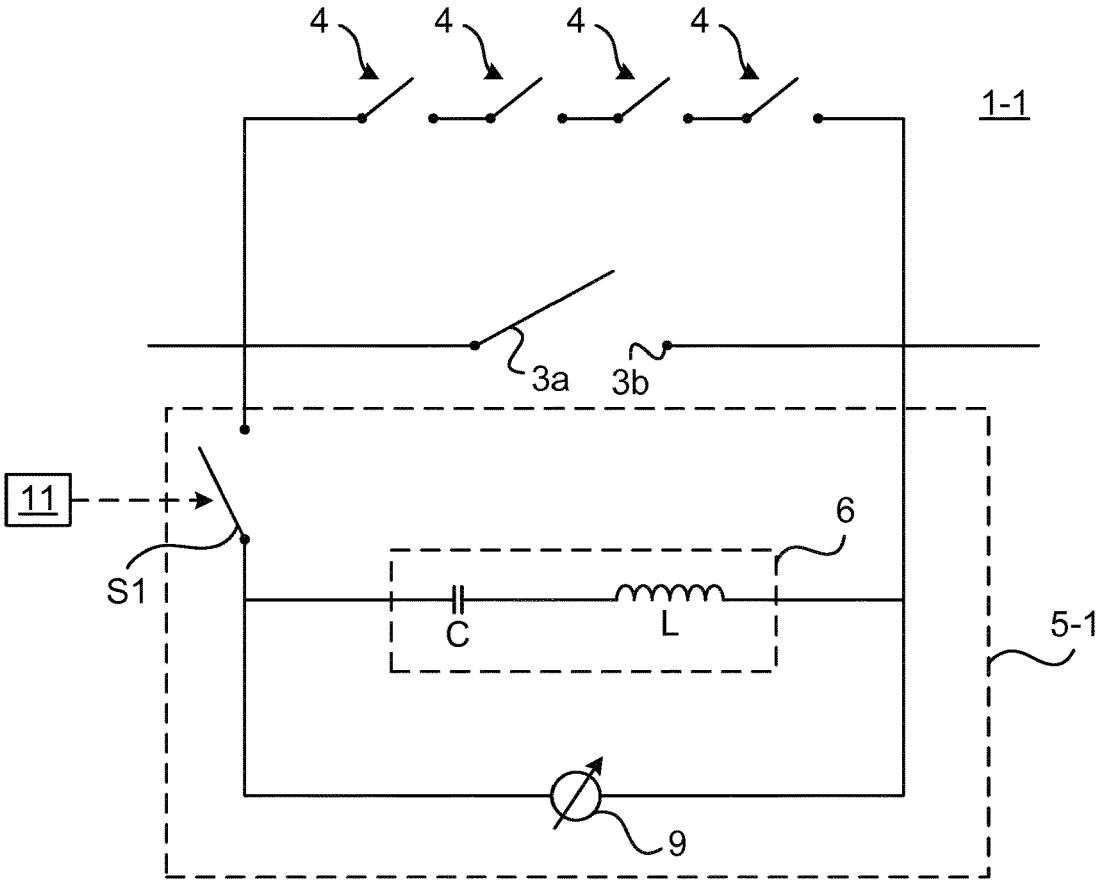
FIG. 2 shows the electrical DC switching system in FIG. 1 with a first implementation of a current injection circuit.

FIG. 2 shows an example of an electrical DC switching system 1-1 including a control system 11 configured to control the first switch S1. The resonance circuit 6 includes a capacitor C and an inductor L, alternatively the circuit inductance. The exemplified current injection circuit 5-1 further includes a DC power source 9 configured to charge the capacitor C to obtain a voltage with reverse polarity relative to that of the power source (not shown) feeding the main contact arrangement 3. The DC power source 9 is configured to maintain the capacitor C in a charged state when the first switch S1 is in the open state.

In the event of a circuit breaking or arc extinguishing operation the first contact 3*a* is first moved away from the second contact 3*b* and the main contact arrangement 3 is thus set in the open position. Current is thereby commutated from the main contact arrangement 3 to the serial contacts 4 which are still in their closed positions. When the current has been commutated to the serial contacts 4, the serial contacts 4 are set in their open positions. Next, the control system 11 is configured to set the first switch S1 in the closed state, whereby a reverse current is injected into the serial contacts 4.

Figure 3:
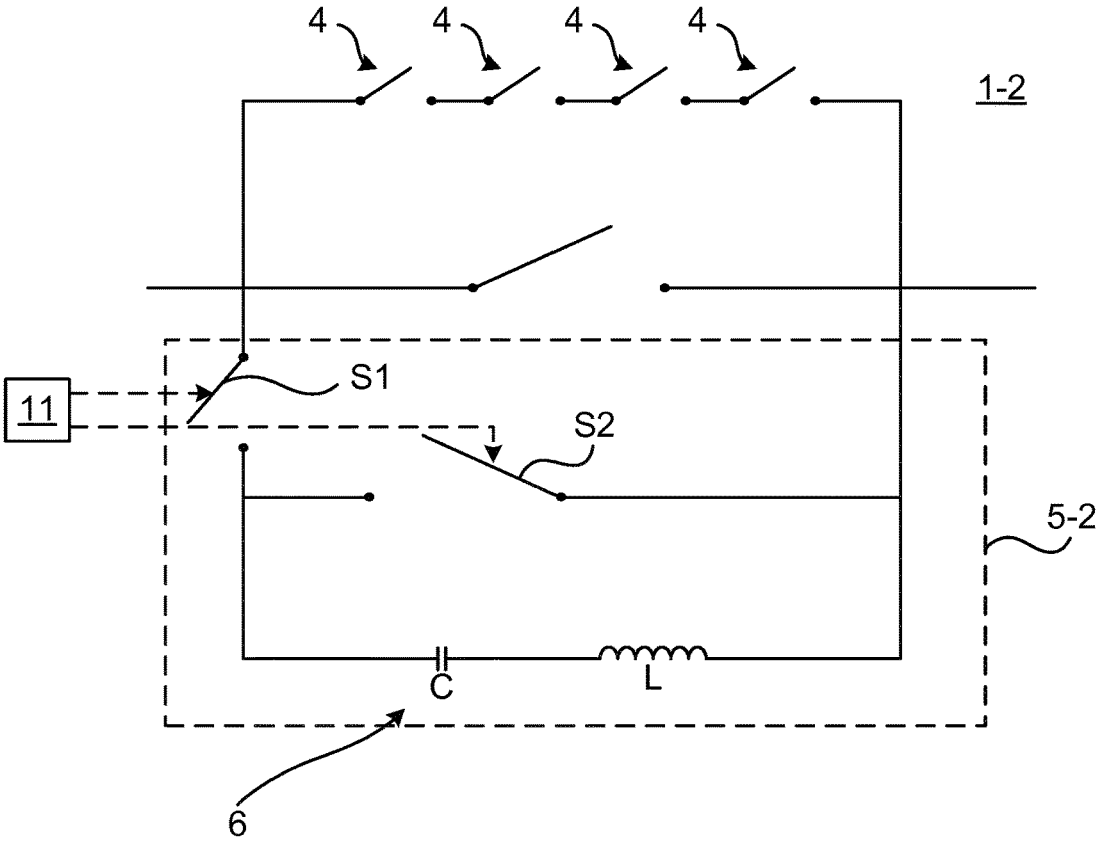
FIG. 3 shows the electrical DC switching system in FIG. 1 with a second example of a current injection circuit.

Another example of an electrical DC switching system is shown in FIG. 3. According to the example in FIG. 3, electrical DC switching system 1-2 comprises a control system 11 and a current injection circuit 5-2 comprising the resonance circuit 6, including the capacitor C and the inductor L, or alternatively the circuit inductance, the first switch S1 and a second switch S2. The current injection circuit 5-2 is a pumping circuit, as will be elaborated upon in more detail in the following.

The resonance circuit 6 is configured to be connected across the serial contacts 4. The resonance circuit 6 is in particular configured to be connected across the serial contacts 4 by means of the first switch S1 and by means of the second switch S2. The first switch S1 is configured to be switched between an open state and a closed state. The first switch S1 is connected to a first serial contact 4, at a first end of the serial contacts 4, and to the resonance circuit 6. The first switch S1 is connected in such a way that in the closed state it enables a current pulse emanating from energy supplied by the arc current to flow in a first flow direction through the resonance circuit 6. It furthermore enables the current to flow into the serial contacts 4 in a direction opposite to the arc current flow direction which flows through the serial contacts 4 via the arc.

The second switch S2 is configured to be switched between an open state and a closed state. The second switch S2 is connected to a second serial contact 4, at a second end of the serial contacts 4, and to the resonance circuit 6. In particular, the second switch S2 is connected across the resonance circuit 6.

As has been previously been described, in the event of a circuit breaking or arc extinguishing operation, the main contact arrangement 3 is set in the open position so that the current commutates into the serial contacts 4 which are still in their closed positions. The serial contacts 4 are subsequently set in their open position. The control system 11 is configured to, when the serial contacts 4 have been set in their open position, alternatingly switch first the first switch S1 between its open state and closed state and then to switch the second switch S2 between its open state and closed state. An injection current pumping functionality is thereby obtained. The control system 11 is configured to be triggered to control the first switch S1 and the second switch S2 by energy supplied by the arc current flowing through the serial contacts 4 now in their open positions. The control system 11 is configured to alternatingly switch first the first switch S1 between its open state and closed state and then to switch the second switch S2 between its open state and closed state until a current pulse, emanating from energy supplied by the arc current, flowing through the resonance circuit 6 and into the serial contacts 4 via the first switch S1 has an amplitude which is equal to or preferably larger than the arc current flowing through the serial contacts 4. At the time when the current pulse has an amplitude that equals the magnitude of the arc current, an artificial zero-crossing is created at the serial contacts 4, facilitating the extinguishing of the arcs over the serial contacts.

The first switch S1, the second switch S2 and the resonance circuit 6 form a pumping circuit, which is configured to inject a current pulse with higher and higher amplitude for each repetition, i.e. for each iteration of alternatingly first set the first switch, and then the second switch, first in the closed state and then in the open state. Depending on the number of switches, and their connection to the resonance circuit, a half-wave pumping circuit, as exemplified above, or a full-wave pumping circuit, as disclosed in WO 2016/131949 A1 may be obtained.

The first switch S1 and the second switch S2 may for example be semiconductor switches such as thyristors or transistors. The control system 11 according to any example provided herein may for example comprise gate drive units for semiconductor switches.

According to any example presented herein, the electrical DC switching system may comprise a varistor, for example a MOV, connected in parallel with the main contact arrangement.

Figure 4A:
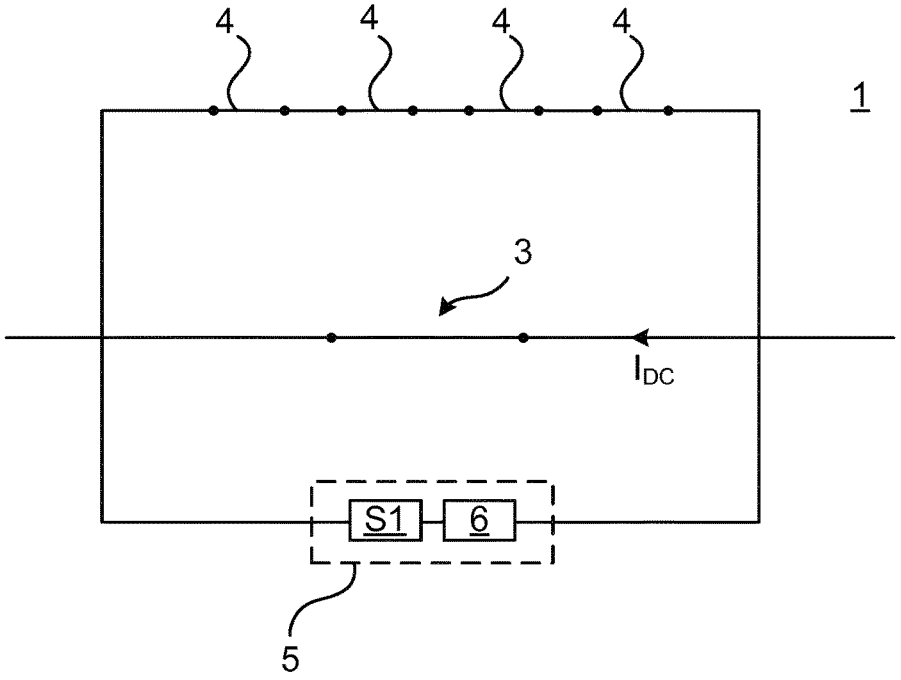
FIGS. 4*a*-4*c* schematically show a current breaking operation by means of an example of the electrical DC switching system.
Figure 4B:
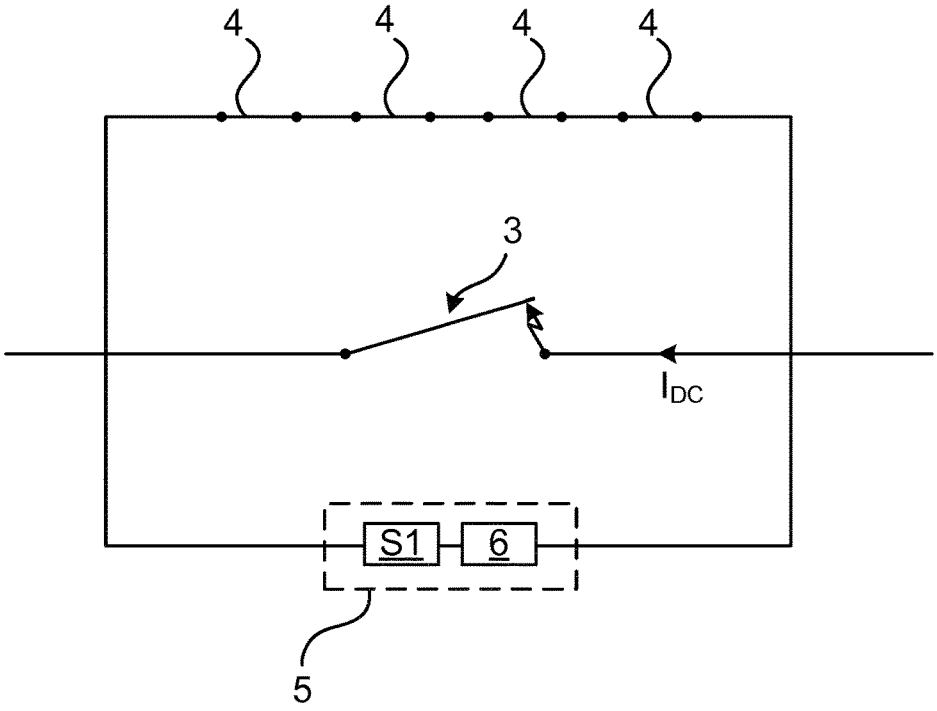
Figure 4C:
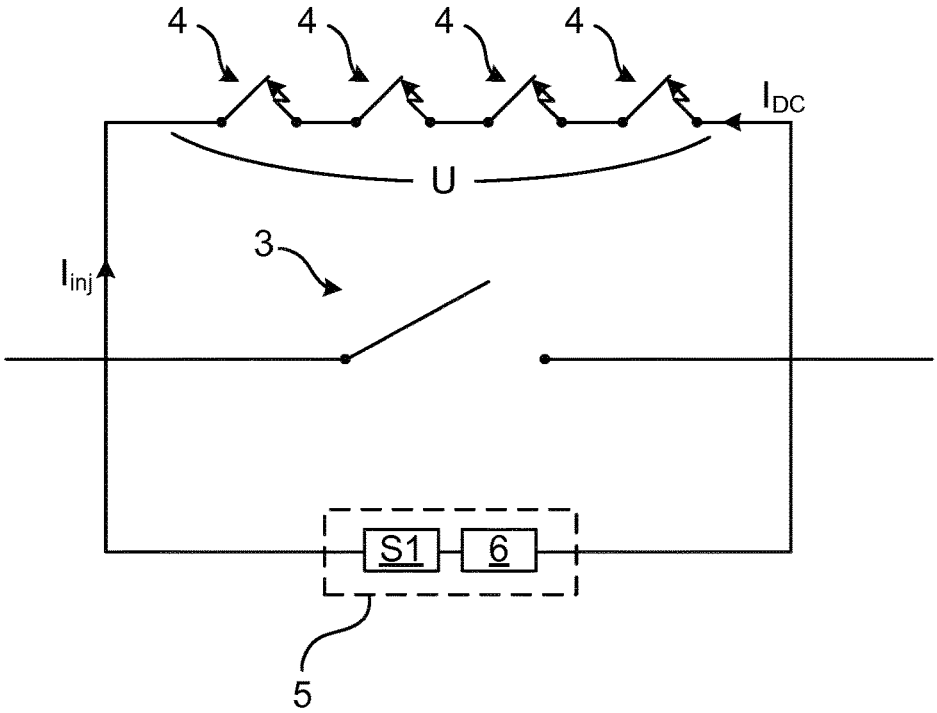

FIGS. 4*a*-4*c* show the electrical DC switching system 1 in operation. In FIG. 4*a*, the electrical DC switching system 1 is shown when the main contact arrangement 3 and the serial contacts 4 are all in their closed position. A DC current $I_{DC}$ flows through the main contact arrangement 3. There will be essentially no current flowing through the serial contacts 4 at this point.

FIG. 4*b* shows a situation where the main contact arrangement 3 has been set in the open position in a current breaking operation. The mechanical contact between the first contact 3*a* and the second contact 3*b* has thus been broken. An arc will thus be ignited between the first contact 3*a* and the second contact 3*b*. The serial contacts 4 are still for a short while in their closed positions. The current $I_{DC}$ will therefore be commutated to the serial contacts 4 and the arc across the main contact arrangement 3 will be extinguished.

In the next stage, shown in FIG. 4*c*, the serial contacts 4 have also been set in their open position and a serial connected arc voltage U is created across the serial contacts 4. This arc voltage U may trigger the current injection circuit 5 to provide an injection current $I_{inj}$ into the serial contacts 4. In the examples shown in FIGS. 2 and 3 the control system 11 may be configured to be triggered by the arc voltage U to provide switching of the first switch S1. When the injection current $I_{inj}$ is equal in magnitude to the current $I_{DC}$ an artificial zero-crossing is created in the serial contacts 4. In this manner, the arcs over the serial contacts 4 may be extinguished and a current breaking operation may be obtained.

The electrical DC switching systems presented herein may for example be a circuit breaker, a contactor, or a current limiter, and may be utilized in DC applications, for example in low voltage (LV) applications or medium voltage (MV) applications.

The inventive concept has mainly been described above with reference to a few examples. However, as is readily appreciated by a person skilled in the art, other embodiments than the ones disclosed above are equally possible within the scope of the inventive concept, as defined by the appended claims.

The invention claimed is:

1. An electrical DC switching system for extinguishing an electric arc, wherein the electrical DC switching system comprises:

a main contact arrangement having a first contact and a second contact, the main contact arrangement being operable between a closed position and an open position, a plurality of serial contacts connected in series with each other and connected in parallel with the main contact arrangement, each serial contact being operable between a closed position and an open position, wherein in a current breaking operation the main contact arrangement is configured to be set in the open position before the plurality of serial contacts are configured to be set in their open positions, and a current injection circuit including a resonance circuit configured to be connected across the serial contacts, and a first switch configured to be switched between an open state and a closed state and configured to be connected to the resonance circuit and to the serial contacts, wherein the first switch is configured to be set in the closed state when the serial contacts are in their open positions to enable an injection current to flow through the resonance circuit and into the serial contacts in a first flow direction which is opposite to a flow direction of an arc current flowing through the serial contacts, wherein each serial contact, consists of a non-magnetic material.

2. The electrical DC switching system as claimed in claim 1, wherein the main contact arrangement consists of a silver or a silver alloy.

3. The electrical DC switching system as claimed in claim 1, wherein the non-magnetic material is brass or zinc.

4. The electrical DC switching system as claimed in claim 1, wherein the resonance circuit includes a capacitor and an inductor.

5. The electrical DC switching system as claimed in claim 4, wherein the current injection circuit includes a DC power source configured to charge the capacitor when the first switch is in the open position.

6. The electrical DC switching system as claimed in claim 1, comprising:

a control system, wherein the current injection circuit includes a second switch connected to the resonance circuit and to the serial contacts, wherein the second switches is configured to be switched between an open state and a closed state, wherein in the closed state the second switch is configured to enable current to flow through the resonance circuit in a second flow direction opposite to the first flow direction, and wherein the control system is configured to alternatingly first set the first switch, and then the second switch, first in the closed state and then in the open state upon a current breaking operation, until a current pulse, emanating from energy supplied by the arc current, flowing through the resonance circuit and into the serial contacts reaches an amplitude which is equal to or greater than a magnitude of the arc current.

7. The electrical DC switching system as claimed in claim 6, wherein in each iteration of alternatingly first setting the first switch, and then the second switch, first in the closed state and then in the open state, the control system is configured to:

set the first switch in the closed position, enabling a first current pulse to flow through the resonance circuit in the first flow direction, set first the first switch in the open state and then the second switch in the closed state when the first current pulse has become zero to enable a second current pulse to flow through the resonance circuit in the second flow direction, and to set the second switch in the open state when the second current pulse first has become zero.

8. The electrical DC switching systems as claimed in claim 6, wherein the second switch is connected across the resonance circuit.

9. The electrical DC switching system as claimed in claim 1, comprising a varistor connected in parallel with the main contact arrangement.

10. The electrical DC switching system as claimed in claim 2, wherein the non-magnetic material is brass or zinc.

11. The electrical DC switching system as claimed in claim 2, wherein the resonance circuit includes a capacitor and an inductor.

12. The electrical DC switching system as claimed in claim 2, comprising:

a control system, wherein the current injection circuit includes a second switch connected to the resonance circuit and to the serial contacts, wherein the second switch is configured to be switched between an open state and a closed state, wherein in the closed state the second switch is configured to enable current to flow through the resonance circuit in a second flow direction opposite to the first flow direction, and wherein the control system is configured to alternatingly first set the first switch, and then the second switch, first in the closed state and then in the open state upon a current breaking operation, until a current pulse, emanating from energy supplied by the arc current, flowing through the resonance circuit and into the serial contacts reaches an amplitude which is equal to or greater than a magnitude of the arc current.

13. The electrical DC switching system as claimed in claim 7, wherein the second switch is connected across the resonance circuit.

14. The electrical DC switching system as claimed in claim 2, comprising a varistor connected in parallel with the main contact arrangement.

* * * * *